United States Patent [19]

Suzuki

[11] Patent Number: 4,585,327

[45] Date of Patent: Apr. 29, 1986

[54] SERVICE LIFE DETERMINING SYSTEM FOR IMAGE BEARING MEMBER OF COPYING APPARATUS AND THE LIKE

[75] Inventor: Minoru Suzuki, Yokohama, Japan

[73] Assignee: Ricoh Company, Ltd., Japan

[21] Appl. No.: 609,579

[22] Filed: May 11, 1984

[30] Foreign Application Priority Data

May 12, 1983 [JP] Japan ..... 58-69833[U]

[51] Int. Cl.[4] ..... G03G 15/00

[52] U.S. Cl. ..... 355/3 R; 355/14 CU

[58] Field of Search ..... 355/3 BE, 14 CU, 16, 355/3 DR, 3 R; 235/144 R; 222/32, 33, 34

[56] References Cited

U.S. PATENT DOCUMENTS 3,588,242 6/1971 Berlier et al. ..... 355/16

FOREIGN PATENT DOCUMENTS 0163276 10/1982 Japan ..... 355/3 DR

*Primary Examiner*—A. T. Grimley
*Assistant Examiner*—J. Pendegrass
*Attorney, Agent, or Firm*—Guy W. Shoup

[57] ABSTRACT

A service life determining system for determining the service life of an image bearing member or a magazine containing an image bearing member removably mounted on a main body of a copying apparatus and the like by counting the number of times of use or a period of time of use, including a resettable counter mounted on the main body of the copying apparatus for counting the number of times or the period of time the image bearing member is used and indicating the result, counter resetting means mounted on the image bearing member or the magazine containing the image bearing member for resetting the counter, and an actuator for actuating the counter resetting means. The actuator for the counter resetting means is operative to actuate the counter resetting means when a new image bearing member is mounted on the main body of the copying apparatus and destroyed when the new image bearing member or the magazine containing the new image bearing member has been set in a predetermined position after the counter resetting means is actuated, whereby the actuator is rendered in capable of actuating the counter resetting means again.

4 Claims, 7 Drawing Figures

SERVICE LIFE DETERMINING SYSTEM FOR IMAGE BEARING MEMBER OF COPYING APPARATUS AND THE LIKE

BACKGROUND OF THE INVENTION

This invention relates to a system for determining the service life of an image bearing member or a magazine containing an image bearing member of a copying apparatus and the like.

Heretofore, it has been usual practice to determine the service life of an image bearing member or a photosensitive member of a copying apparatus based on the number of times the photosensitive member is rendered operative as indicated by a counter attached to a main body of the copying apparatus and to replace the old photosensitive member by a new one by a service clerk when a predetermined number of times is reached.

Copying apparatus have nowadays become very popular and are used widely not only in business offices but also for personal use at home. It has become necessary to reduce expenses for servicing the machines by letting the users perform replacements of photosensitive members themselves without requiring servicing by a service clerk. When the users are required to take care of the photosensitive members, the system of determining the service life of a photosensitive member now in use which relies on the operation of a counter to count and indicate the number of times it is rendered operative would suffer disadvantages. If the system is of a type in which the counter is not resettable, the users might forget to keep a record of the number of times the counter indicated at the time the replacements took place the last time. Even if the counter used is resettable, the users might forget to reset the counter. Also, when an old photosensitive member that has reached the end of its service life and replaced by a new one or a magazine containing the old photosensitive member is put in an empty box that used to contain the new photosensitive member or magazine that has replaced the old one, there would be the risk that the photosensitive member or magazine in the box might be mistaken for a new one and inadvertently mounted on the copying apparatus, resulting in the production of copies of poor quality.

To obviate this problem, proposals have been made to provide each of the replaceable kits including a photosensitive member with means for determining the service life, to enable the users to learn the service life of the kit in use, as disclosed in Japanese Patent Application Laid-Open No. 57-163276 for example. When this solution of the problem is adopted, the users would be able not only to determine when the kit now in use would reach the end of its service life but also to learn that the used kit has reached the end of its service life.

However, this solution of the problem is not without disadvantages. The kits are disposable and it would cause a rise in cost to provide each of them with means for determining the service life.

SUMMARY OF THE INVENTION

This invention has been developed for the purpose of obviating the aforesaid disadvantages of the prior art suffered in the field of art of copying apparatus in determining the service life of a photosensitive member or a magazine containing it. Accordingly, the invention has as its object the provision of a system for determining the service life without fail which is capable of avoiding the risk of the users inadvertently using the photosensitive member that has reached the end of its service life by mistaking it for a new one.

To accomplish the aforesaid object, the invention provides a service life determining system comprising a counter with resetting means mounted on a copying apparatus main body, and a resetting means actuating member mounted on a photosensitive member or a magazine containing a photosensitive member operative to reset the counter by actuating the resetting means in the process of mounting the photosensitive member or the magazine containing a photosensitive member, the resetting means actuating member being destroyed when counter resetting has been finished.

DESCRIPTION OF THE PREFERRED EMBODIMENTS

Figure 1:
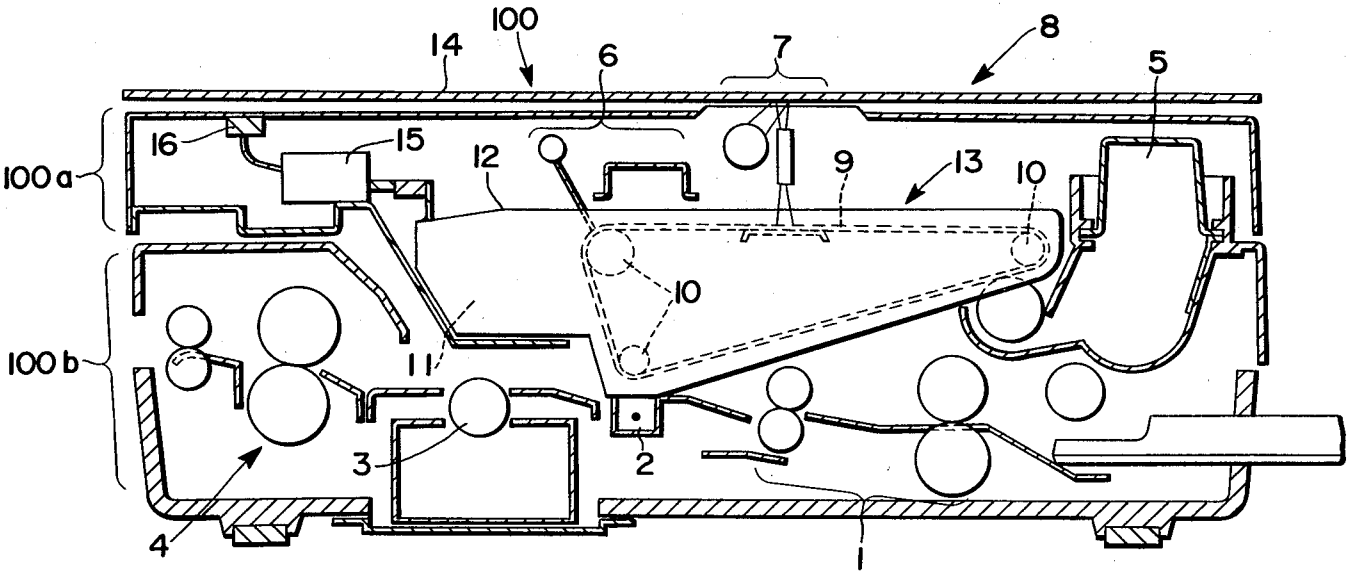
FIG. 1 is a sectional view of a copying apparatus incorporating therein one embodiment of the invention.
Figure 2:
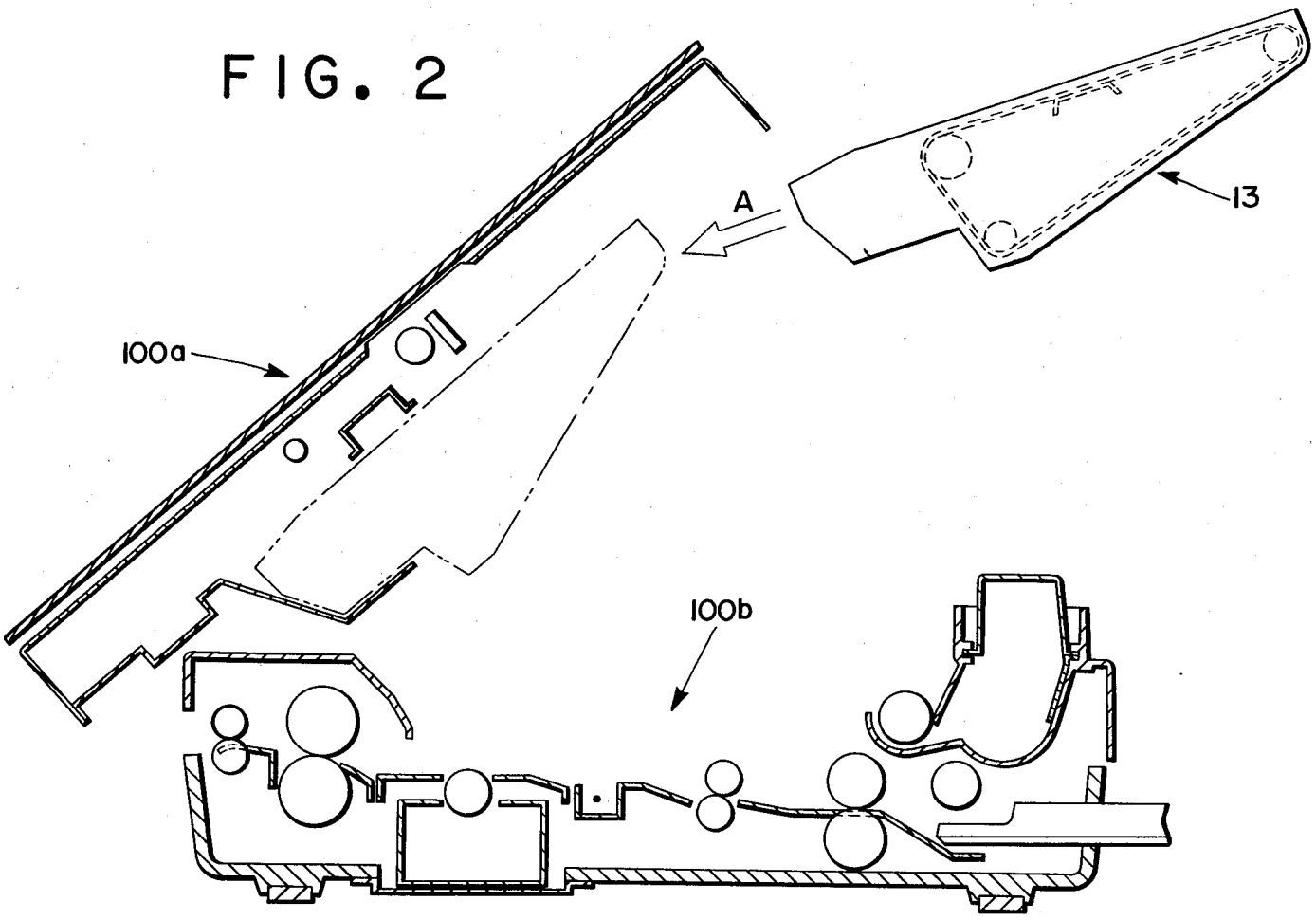
FIG. 2 is a sectional view of the copying apparatus shown in FIG. 1, showing the manner in which the photosensitive member magazine is being mounted on the main body of the copying apparatus.

Referring to FIG. 1, the copying apparatus comprises a main body 100 composed of two structural bodies or an upper structural body 100*a* and a lower structural body 100*b* separable from each other as shown in FIG. 2. The lower structural member 100*b* has located therein a sheet feeding section 1, a transfer-printing section 2, a conveying section 3, a fixing section 4 and a developing section 5. The upper structural body 100*a* has located therein a charging and charge removing section 6, an exposing optical system 7 and a document slider 8. The upper structural body 100*a* has removably mounted therein a magazine 13 containing therein a photosensitive belt 9 of endless form, rollers 10 for supporting the photosensitive belt 9 for movement, a cleaning section and a toner container 11 and housed in a casing 12. The magazine 13 is mounted on and removed from the main body 100 by separating the upper and lower structural bodies 100*a* and 100*b* from each other as shown in FIG. 2. The upper structural body 100*a* has at its top surface a document support glass member 14, and a counter 15 is located immediately below the document support glass member 14 in a position anterior to a position which is occupied by a forward end of the magazine 13 when the latter is mounted in the main body 100. The counter 15 counts the number of times the photosensitive member 9 is rendered operative by a known method, as by counting the number of signals generated when copies are produced, the number of times the document slider 8 is moved or the number of movements of the photosensitive member 9, and when the count has reached a predetermined number for replacing the magazine 13 by a new one, a light emitting diode (LED) 16 located in a position in which it is readily recognized by the user is actuated to emit light, indicating that the service life of the photosensitive member 9 has come to an end. Preferably, the counter is located in a position in which the count can be recognized by the user through the document support glass member 14.

Figure 3:
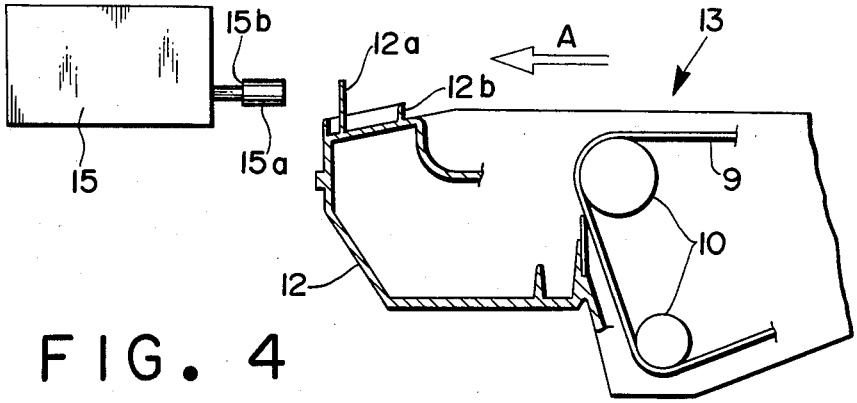
FIG. 3 is a view showing the forward end portion of the photosensitive body magazine in relation to the service life determining means.

The counter 15 which is resettable includes a reset rod 152 which, as shown in FIG. 3, extends toward the magazine 13. By inserting the reset rod 15*a* into a casing of the counter 15 until a shoulder 15*b* abuts against an outer wall surface of the casing of the counter 15 and then releasing a force for inserting the reset rod 15*a*, it is possible to restore the reset rod 15*a* to its original position by the biasing force of a spring mounted in the casing of the counter 15 after the counter 15 is reset.

Figure 4:
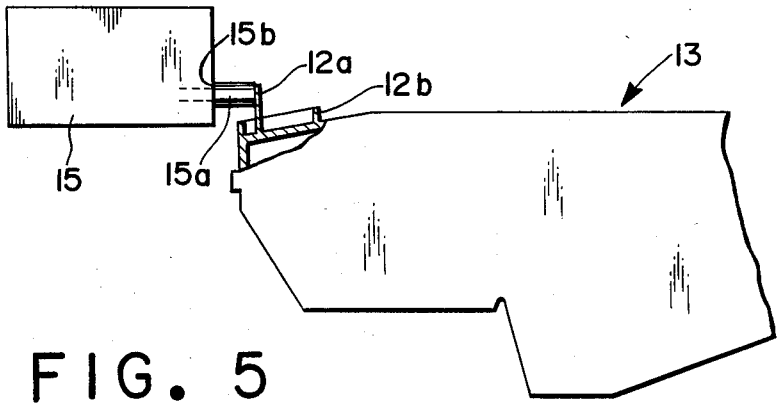
FIGS. 4 and 5 are views in explanation of the operation of the service life determining means.
Figure 5:
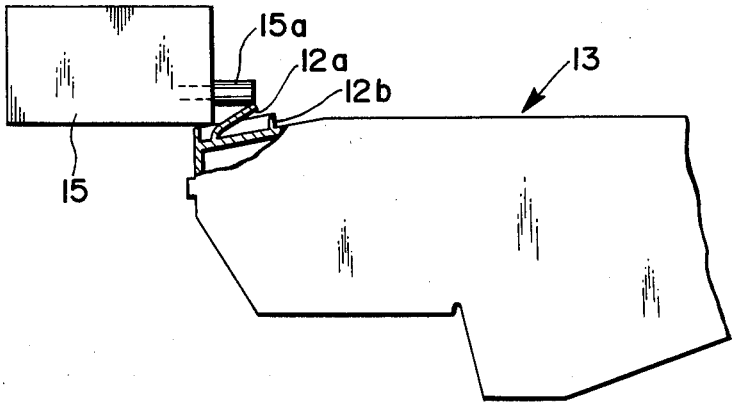

The casing 12 of the magazine 13 has located near its forward end a projection 12*a* which pushes at its front surface the end of the reset rod 15*a* of the counter 15 when the magazine 13 is mounted in the upper structural body 100*a* of the main body 100 of the copying apparatus. The shoulder 15*b* of the reset rod 15*a* is brought into abutting engagement with the outer surface of the casing of the counter 15 as shown in FIG. 4 before the magazine 13 is set in a predetermined position in the upper structural body 100*a*. Further forward movement of the magazine 13 to the predetermined position causes the forward end of the reset rod 15*a* to destroy, that is, to deflect or bend the projection 12*a* downwardly into magazine enclosure 12*b*, positioning the shoulder 15*b* in abutting engagement with the outer surface of the casing of the counter 15 as shown in FIG. 5. The enclosure 12*b* surrounds the projection 12*a* in order to prevent it from dropping into the interior of the main body 100 of the copying apparatus.

The preferred embodiment of the photosensitive member service life determining system of the invention is constructed as described above and shown in the drawings. As copying operations are performed repeatedly while the number of the operations performed is counted by the counter 15 and the count reaches a predetermined value for replacing the magzine 13 by a new one, the LED 16 is actuated to emit light, indicating that the service life of the photosensitive member 9 has come to an end. Whereupon, the user separates the upper structural body 100*a* from the lower structural body 100*b*, and a new magazine is set in position as indicated by an arrow A in FIGS. 2 and 3 after removing the magazine 13 from the upper structural body 100*a*. As the new magazine is inserted in the upper structural body 100*a*, the reset rod 15*a* is pushed by the projection 12*a* at the forward end of the magazine until the shoulder 15*b* of the reset rod 15*a* is brought into abutting engagement with the outer surface of the counter casing as shown in FIG. 4, to thereby reset the counter 15. Then, as the new magazine is further moved forwardly, the projection 12*a* is pushed by the forward end of the reset rod 15*a* and destroyed as shown in FIG. 5. Then, the upper structural body 100*a* is combined with the lower structural body 100*b*, to bring the copying apparatus main body 100 to a condition for operation.

While the magazine 13 set in position in the upper structural member has not come to the end of its service life yet, it may become necessary to temporarily remove the magazine 13 from the main body 100 of the copying apparatus when some trouble, such as jamming, occurs. Since the projection 12*a* is already destroyed, no resetting of the counter 15 takes place even if the magazine 13 is inserted in the upper structural body 100*a* again, so that the counter 15 continues to count the number of operations following the count already made at the time the magazine 13 was temporarily removed.

When a used magazine that has reached the end of its service life is inadvertently mounted in the upper structural member 100*a*, the counter 15 is not reset because the projection 12*a* is already destroyed, and the LED emits light as soon as a main switch is actuated, informing the user that the magazine in the predetermined position is no longer fit for service, thereby keeping copies of poor quality from being produced.

Figure 6:
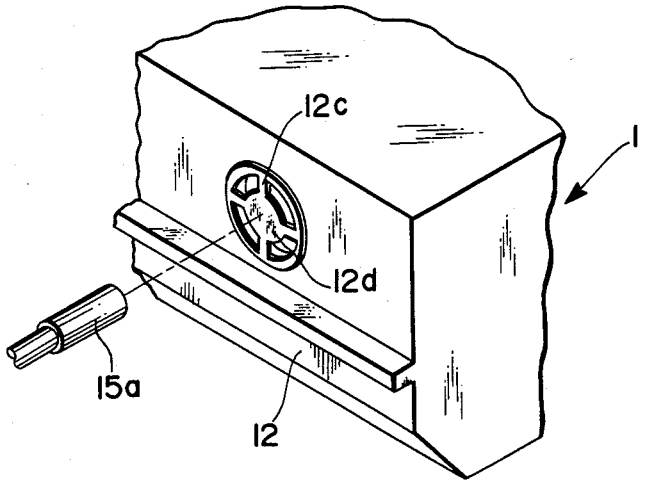
FIG. 6 is a perspective view of another embodiment of the invention.
Figure 7:
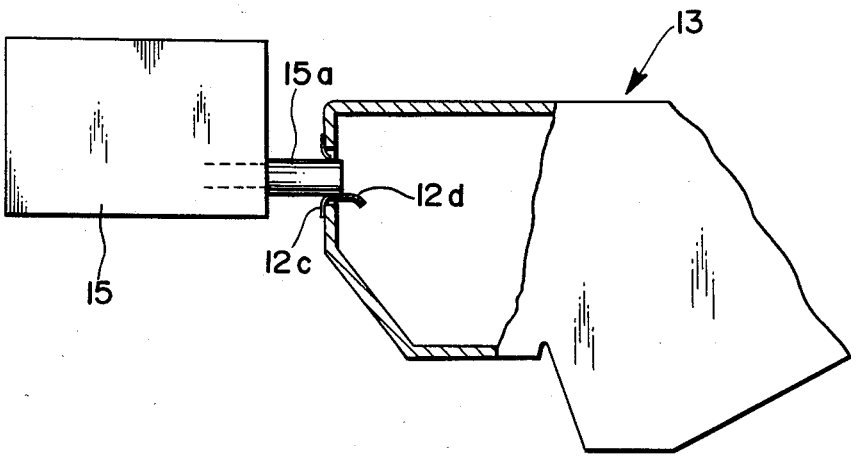
FIG. 7 is a view in explanation of the operation of the embodiment of the invention shown in FIG. 6.

FIG. 6 shows another embodiment of the invention wherein a pressing member 12*d* formed at a front end wall of the casing 12 of the magazine 13 and a set of fine connecting members 12*c* for connecting the pressing member 12*d* to the surface of the front end wall of the casing 12 replace the projection 12*a* shown in FIGS. 3–5. When the magazine 13 is mounted on the upper structural body 100*a*, the reset rod 15*a* of the counter is forced into the casing of the counter 15 by the pressing member 12*d*, until the counter 15 is reset. Further movement of the reset rod 15*a* results in the connecting members 12*c* being destroyed as shown in FIG. 7 and the pressing member 12*d* being removed from the casing 12, when the magazine is set in a predetermined position.

In the embodiments shown in FIGS. 3–6, it is possible for the user to readily find out whether the magazine 13 is a new one or a used one by checking on the condition of the projection 12*a* and pressing member 12*d*.

In the embodiments shown and described hereinabove, the invention has been described as being incorporated in a copying apparatus in which a photosensitive member is contained in a magazine and a magazine is replaced by a new one when the service life comes to an end. However, the invention is not limited to this specific type of copying apparatus and may be incorporated in a copying apparatus of the type in which a photosensitive drum, a photosensitive belt or other image bearing member is replaced by a new one without using a magazine. Although the counter 15 has been described as being of a type in which the number of times copying operations are performed is counted, the invention is not restricted to this type of counter, and the counter may be of any other suitable type, such as the one in which the period of time the photosensitive member is rendered operative is measured by counting pulses generated at predetermined intervals of time.

From the foregoing description, it will be appreciated that in the service life determining system for an image bearing member of a copying apparatus and the like according to the invention, the service life determining means is reset in conjunction with replacing an old image bearing member or a magazine containing an old image bearing member by a new one, and the service life determining means is not reset if an image bearing member or a magazine containing an image bearing member that has once been set in position in the main body of the copying apparatus is set again. Thus, it is possible to accurately determine the service life of an image bearing member, and the user can readily determine when the image bearing member now in use should be replaced by a new one. An additional advantage offered by the invention is that since the service life determining means in the form of a counter is mounted on the main body of the copying apparatus it is possible to reduce the costs of image bearing members or magazines for containing image bearing members which are disposable.

What is claimed is:

1. A service life determining system for determining the service life of an image bearing member or a magazine for containing an image bearing member removably mounted on a main body of a copying apparatus and the like by counting the number of times of use or a period of time of use, comprising:

a counter mounted on the main body of the copying apparatus for counting the number of times or the period of time the image bearing member is used and indicating the result, said counter being resettable;

counter resetting means for resetting the counter; and an actuator mounted on the image bearing member or the magazine containing the image bearing member for actuating the counter resetting means;

wherein said actuator is operative to actuate said counter resetting means when a new image bearing member is mounted on the main body of the copying apparatus and destroyed when the new image bearing member or the magazine containing the new image bearing member has been set in a predetermined position after the counter resetting means is actuated, whereby the actuator is rendered incapable of actuating the counter resetting means again.

2. A service life determining system as claimed in claim 1, wherein said counter resetting means comprises a reset rod extending outwardly of the counter, and a shoulder on the reset rod whereby the counter can be reset as the reset rod is inserted in the counter until the shoulder abuts against an outer surface of a casing of the counter, and wherein said actuator for actuating the counter resetting means comprises a projection on the image bearing member or the magazine containing the image bearing member, said projection being operative to force the reset rod into the counter when the image bearing member or the magazine containing the image bearing member is mounted on the main body of the copying apparatus to reset the counter, said projection being destroyed when the reset rod is further pressed by said projection after the shoulder is brought into abutting engagement with the outer surface of the casing of the counter.

3. A service life determing system as claimed in claim 1, wherein said counter resetting means comprises a reset rod provided with a shoulder projecting from the counter, said reset rod being operative to reset the counter as it is forced into the counter until said shoulder abuts against an outer surface of a casing of the counter, and wherein said actuator for actuating the counter resetting means comprises a pressing member on the image bearing member or a casing of the magazine containing the image bearing member connected to the casing through a set of fine connecting members, said pressing member being operative to force the reset rod into the counter until the shoulder abuts against the outer surface of the casing of the counter, said pressing member being destroyed by the reset rod after the shoulder is brought into abutting engagement with the outer surface of the casing of the counter.

4. A service life determining system as claimed in claim 2, wherein an enclosure is provided in the image bearing member or the magazine containing the image bearing member in a manner to surround said projection whereby said projection is prevented from dropping into the interior of the main body of the copying apparatus when it is destroyed.

* * * * *